US008286564B2

(12) United States Patent
Karl et al.

(10) Patent No.: US 8,286,564 B2
(45) Date of Patent: Oct. 16, 2012

(54) SHELF SUPPORT SYSTEM

(75) Inventors: Philip J. Karl, Providence, RI (US); Errol Drew, Gerrards Cross (GB)

(73) Assignee: Delta Cycle Corporation, Foxboro, MA (US)

( * ) Notice: Subject to any disclaimer, the term of this patent is extended or adjusted under 35 U.S.C. 154(b) by 369 days.

(21) Appl. No.: 12/583,145

(22) Filed: Aug. 14, 2009

(65) Prior Publication Data

US 2011/0036278 A1 Feb. 17, 2011

(51) Int. Cl.
*A47B 9/00* (2006.01)

(52) U.S. Cl. ..... 108/107; 108/147.13

(58) Field of Classification Search ..... 108/106, 108/107, 108, 147.11, 147.12, 147.13, 147.14, 108/147.15; 211/187, 103, 190, 207, 180, 211/182

See application file for complete search history.

(56) References Cited

U.S. PATENT DOCUMENTS

| | | | | | |
|---|---|---|---|---|---|
| 3,523,508 | A * | 8/1970 | Maslow | 108/147.13 |
| 3,664,274 | A * | 5/1972 | Bustos | 108/147.13 |
| 3,757,705 | A * | 9/1973 | Maslow | 108/147.13 |
| 4,158,336 | A * | 6/1979 | Brescia et al. | 108/190 |
| 4,257,333 | A * | 3/1981 | Pollack | 108/147.13 |
| 4,318,352 | A * | 3/1982 | Friedman et al. | 108/107 |
| 4,595,107 | A * | 6/1986 | Welsch | 211/187 |
| 4,656,952 | A * | 4/1987 | Schweizer | 108/11 |
| 4,811,670 | A * | 3/1989 | Kolvites et al. | 108/107 |
| 5,415,302 | A | 5/1995 | Carlson et al. | |
| 5,531,167 | A | 7/1996 | Stevens et al. | |
| 5,601,038 | A | 2/1997 | Welch et al. | |
| 5,806,417 | A * | 9/1998 | Whiten et al. | 108/106 |
| 6,068,143 | A * | 5/2000 | Wang | 211/187 |
| 6,079,575 | A * | 6/2000 | Wang | 211/187 |
| 6,116,436 | A | 9/2000 | Ferrucci et al. | |
| 6,158,600 | A | 12/2000 | Ferrucci et al. | |
| 6,364,138 | B1 * | 4/2002 | Chen | 211/187 |
| D462,541 | S | 9/2002 | Welch | |
| 6,619,489 | B2 * | 9/2003 | Kessel et al. | 211/181.1 |
| 6,726,040 | B1 * | 4/2004 | Chen | 211/187 |
| 6,918,341 | B1 | 7/2005 | Welsch et al. | |
| 7,407,060 | B2 | 8/2008 | Swartz et al. | |
| 8,016,140 | B2 * | 9/2011 | Hsieh | 211/187 |
| 2002/0046982 | A1 * | 4/2002 | Guizzardi | 211/187 |
| 2005/0199160 | A1 * | 9/2005 | Ching-Po | 108/107 |
| 2007/0034584 | A1 * | 2/2007 | Park | 211/187 |

* cited by examiner

*Primary Examiner* — Jose V Chen
*Assistant Examiner* — Matthew Ing
(74) *Attorney, Agent, or Firm* — Iandiorio Teska & Coleman LLP

(57) ABSTRACT

A shelf support system including a collet lock for engaging a hole in the shelf post for arresting downward movement of a shelf support collar on the post.

12 Claims, 5 Drawing Sheets

SHELF SUPPORT SYSTEM

FIELD OF THE INVENTION

This invention relates to a shelf support system and more particularly to a such a shelf support system using an improved collar and locking arrangement.

BACKGROUND OF THE INVENTION

Conventional modular, knock down, shelving structures use a wide variety of gripping and fastening devices to allow for support of the shelves and to allow shelf height adjustability. See U.S. Pat. Nos. 5,415,302, Carlson et al.; 5,531,167, Stevens et al.; 5,601,038, Welch et al.; 6,116,436, Ferrucci et al.; 6,158,600, Ferrucci et al,; D462,541S, Welch; 6,918,341 B1, Welsch et al.; and 7,406,060 B2 Swartz et al, all incorporated herein by this reference. Many approaches use tapered members (referred to as frustro-conical when complementing a circular cylindrical support post) to create a wedging effect to secure the posts. Such devices historically have used gripping features such as beads and grooves which must be fabricated in or machined in to the mating parts. Further, locking devices of a complex nature have been used in conjunction with other features to ensure a secure engagement between the shelf support post and the member or members which are to support a shelf.

SUMMARY OF THE INVENTION

In accordance with various aspects of the subject invention in at least one embodiment the invention presents an improved shelf support system which is safe and secure yet simple and cost effective to manufacture from a variety of materials e.g. metal, plastic using a few, simple parts.

The subject invention, however, in other embodiments, need not achieve all these objectives and the claims hereof should not be limited to structures or methods capable of achieving these objectives.

This invention features a shelf support system including, a tapered collet diverging from top to bottom for engaging a shelf post, a collet lock for engaging a hole in the shelf post for arresting downward movement of the collet on the post, and a shelf support collar for securely engaging the tapered collet to support a shelf.

In a preferred embodiment the collet may be longitudinally split to allow spreading of the collet for installation on a shelf pole. The collet may include a recess for nesting at least a portion of the collet lock. The collet may include a lip about at least a part of the lower portion of the collet for further securing the shelf support collar. The collet lock may include a lock portion for engaging a hole in a shelf post and a base contoured to the post. The collar and collet may be cylindrical. The collar and collet may be circularly cylindrical. The collar and collet may further include a post with a plurality of spaced holes for receiving at least one collet lock.

This invention also features a shelf support system including a plurality of shelf posts each with a number of spaced holes, a plurality of tapered collets for engaging the shelf posts, a plurality of collet locks one associated with each collet for engaging holes in the shelf posts for arresting downward movement of the collet on the post, and a plurality of shelf support collars for securely engaging each tapered collet to support a shelf.

In a preferred embodiment each collet may be longitudinally split to allow spreading of the collet for installation on a shelf pole. Each collet may include a recess for nesting at least a portion of the collet lock. Each collet may include a lip about at least a part of the lower portion of the collet for further securing the shelf support collar. Each collet lock may include a lock portion for engaging a hole in a shelf post and a base contoured to the post. Each collar and collet may be cylindrical. Each collar and collet may be circularly cylindrical.

This invention also features a shelf support system including a combination collar including, a collar member for mounting on a shelf post, and a lock member extending saliently inwardly of the collar member for engaging a hole in the shelf post.

In a preferred embodiment the collar member may be longitudinally split to allow spreading of the collet for installation on a shelf post.

This invention also features a shelf support system including a plurality of shelf posts each with a number of spaced holes, a plurality of combination collars for engaging the shelf posts, each combination collar including a collar member for mounting on a shelf post and a lock member extending saliently inwardly of the collar member for engaging a hole in the shelf post.

In a preferred embodiment each collar member may be longitudinally split to allow spreading of the collet for installation on a shelf post.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 2:
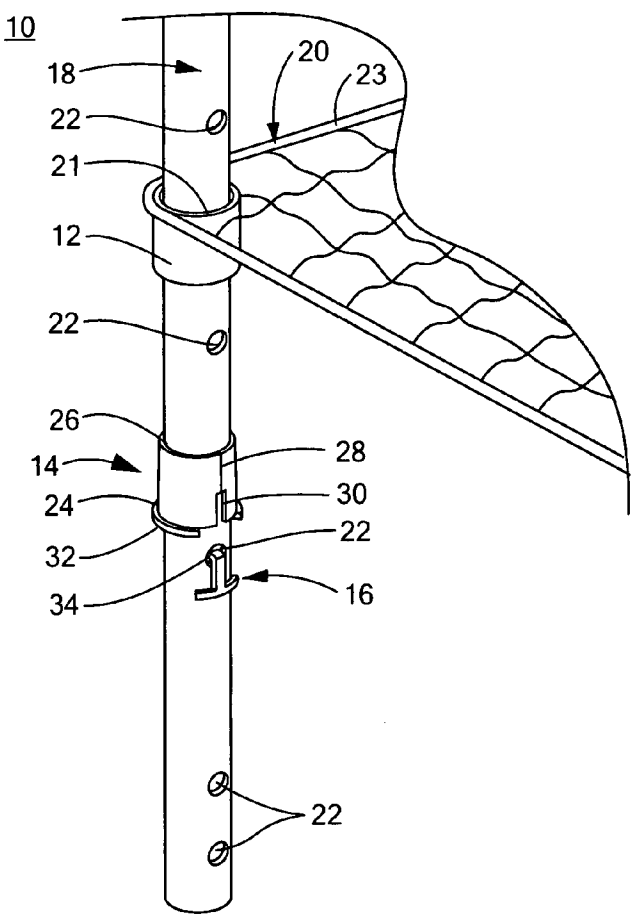
FIG. 2 is a diagrammatic, three dimensional view similar to FIG. 1 showing the collet lock in place on the shelf support post.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 1:
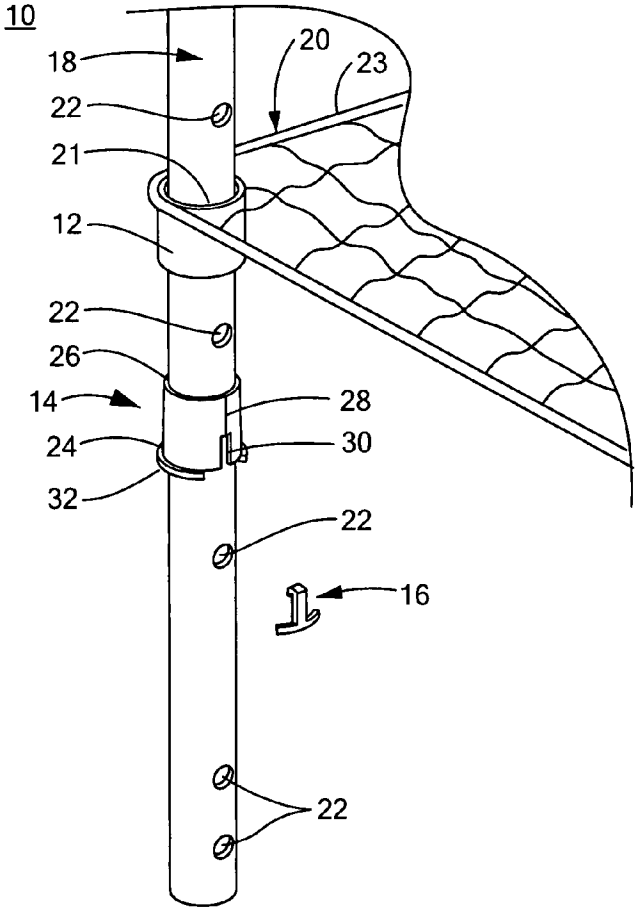
FIG. 1 is a diagrammatic, three dimensional view of a shelf support system according to this invention showing the support collar and collet installed on a shelf support post.

There is shown in FIG. 1 a shelf support system 10 according to this invention including a collar 12, a tapered collet 14 having a frusto-conical shape and a collet lock 16 which cooperate with post 18 to support a shelf such as open wire shelf 20 by resting peripheral support member 21 on the tops 23 of collars 12. Post 18 may have a number of spaced holes 22, to receive collet lock 16 for purposes of adjustability of shelves and for enabling a number of shelves to be mounted on post 18. Collet 14 diverges downwardly so that its lower portion 24 has a greater diameter than its upper portion 26. Collet 14 may also be provided with a split 28 so that it can be spread apart for installation and removal from post 18 without the need to slide it on the post from top or bottom. In this way shelves may be added quickly and easily without disturbing top, bottom, or intermediate shelves. Collet 14 may also include a recess 30 for receiving collet lock 16. Recess 30 is shown aligned with split 28 but this in not a necessary limitation as either of them could be placed anywhere around the circumference of collet 14. Collet 14 may also have an outwardly extending lip 32 around at least a part of its bottom portion 24. In FIG. 2, collet lock 16 has been mounted on post 18 by putting its upper hooked end 34 into one of holes 22, FIG. 2. Post 18, collet 14, and collar 12, may be plastic or similar material or may be made of metal, depending upon the strength and cost constraints. Collet lock 16 may be metal, such as die cast or sintered steel, or may as well be plastic depending upon the strength required.

Figure 3:
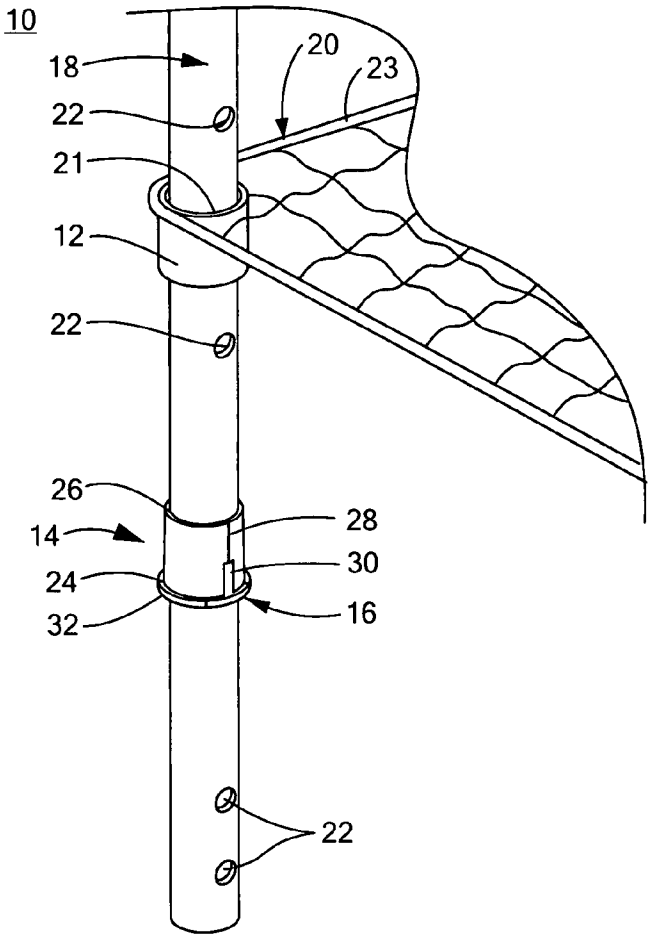
FIG. 3 is a diagrammatic, three dimensional view similar to FIG. 2 showing the collet engaged with the collet lock.

In FIG. 3 collet 14 has been moved down to engage collet lock 16 which has previously been engaged with a hole 22. Because collet 14 is provided with recess 30 collet lock 16 nests neatly therein.

Figure 4:
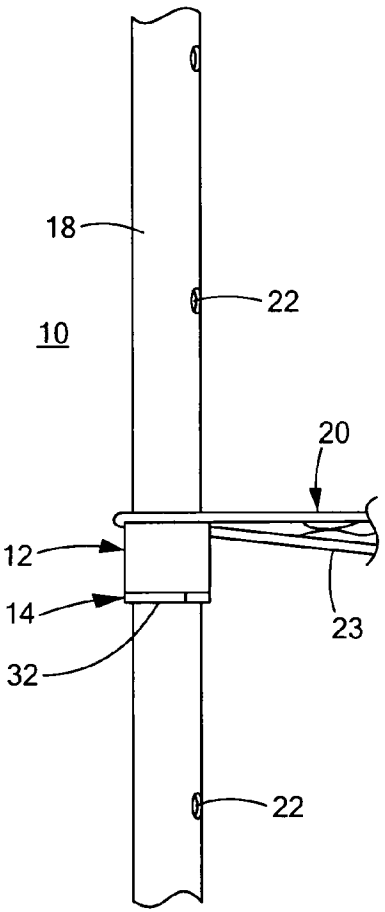
FIG. 4 is a diagrammatic, three dimensional view similar to FIG. 3 showing the collar secured to the collet.

In FIG. 4 collar 12 has been moved down and engaged with tapered collet 14. The wedging action provided by the taper of collet 14 ensures a secure fit between collar 12 and collet 14. In addition, if as in this particular embodiment a lip 32 is provided, a further positive engagement is provided.

Figure 5:
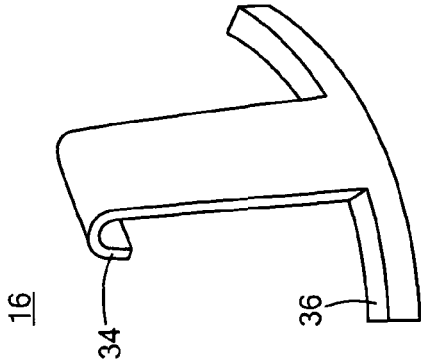
FIG. 5 is a three dimensional view of one construction of the collet lock in accordance with this invention.

Collet lock 16 may take a number of different shapes. One such shape is shown in FIG. 5 where its upper portion 34 is curved to fit through a hole 22 and actually hang in post 18. Collet lock 16 also has a base portion 36 which is contoured to fit the outside surface of post 18. In this case since post 18 is shown as a cylinder and more specifically a circular cylinder, base 36 has a curved contour having the same radius as post 18 to ensure a snug fit. While only a right circular cylinder embodiment is shown other shapes, e.g. square, rectangular, oval are also contemplated by the invention. Top portion 34 need not be curved and need not be hooked just so long as it provides a means for gripping post 18. A hole and hook are simply an easy example to show and explain.

Figure 6:
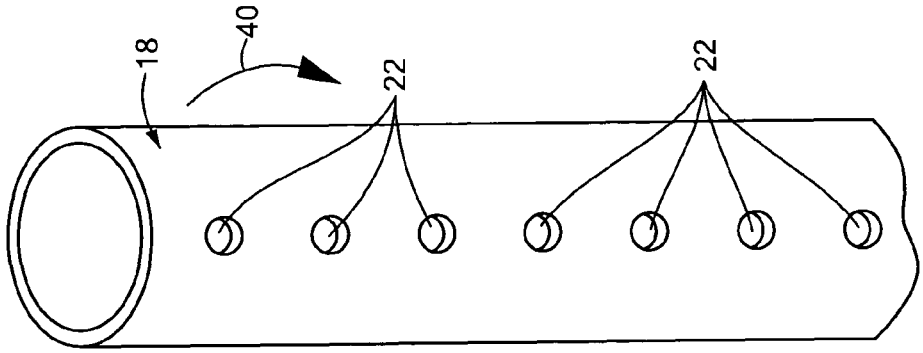
FIG. 6 is a three dimensional view of a collet spread open and about to encompass a post.
Figure 6:
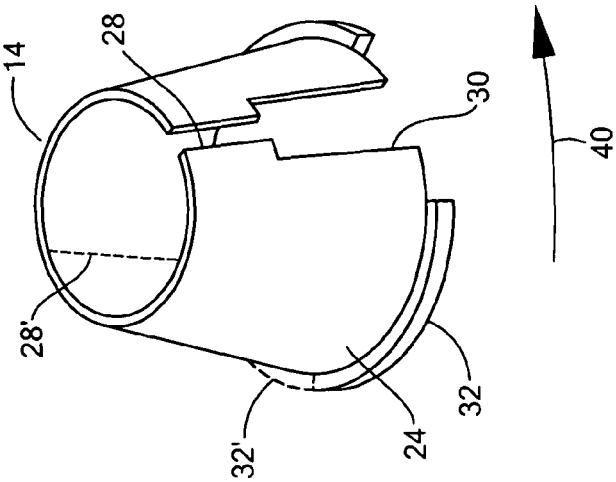

Tapered collet 14, is shown in more detail in FIG. 6, where the taper is even a bit exaggerated for purposes of illustration. Split 28 is aligned with recess 30 which receives collet lock 16, however, this is not a necessary limitation of the invention as indicated previously. For example the split could be as shown in phantom at 28'. Lip 34 as shown previously can extend completely around the lower portion 24 of collet 14, or it may just extend around a portion and part of the collet may be without a lip as shown in phantom at 32'. In FIG. 6 collet 14 has been spread apart at the split 28 so that it can be installed directly around post 18 as indicated by arrows 40, without the need to slide it over the top or up from the bottom. In this way it can be installed between other shelves that are already in place without having to remove and replace them.

Figure 7:
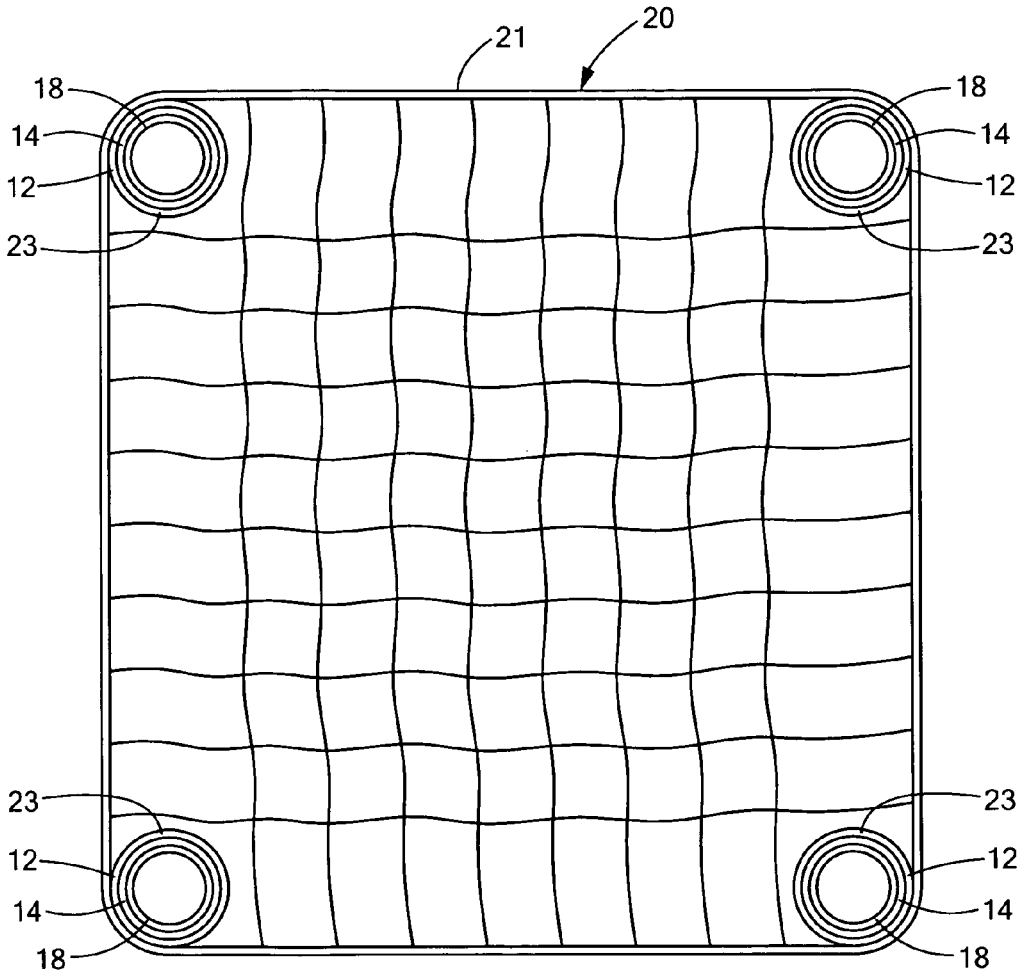
FIG. 7 is a top plan view of a shelf support system according to this invention showing four collars, collets and collet locks on four posts supporting a wire shelf.

A system according to this invention using four posts and four sets of collars, collets and collet locks, is shown in FIG. 7 with open wire shelf 20 resting on the top of collars 12. The outer peripheral support member 21 of shelf 20 rests on the tops 23 of collars 12.

Figure 8:
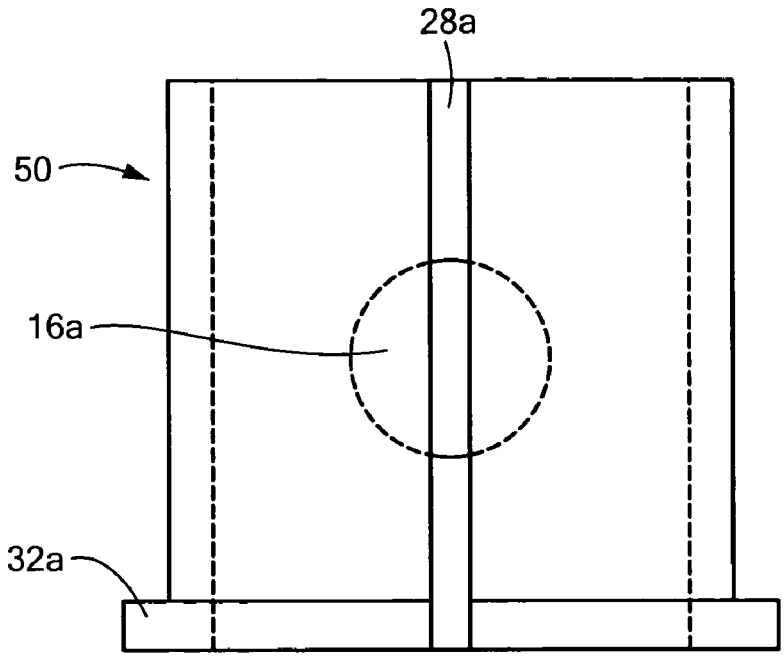
FIG. 8 is a diagrammatic front elevation and FIG. 9 is a diagrammatic plan view of another embodiment of the invention using a combination collar including functions of the collet and collet lock.
Figure 9:
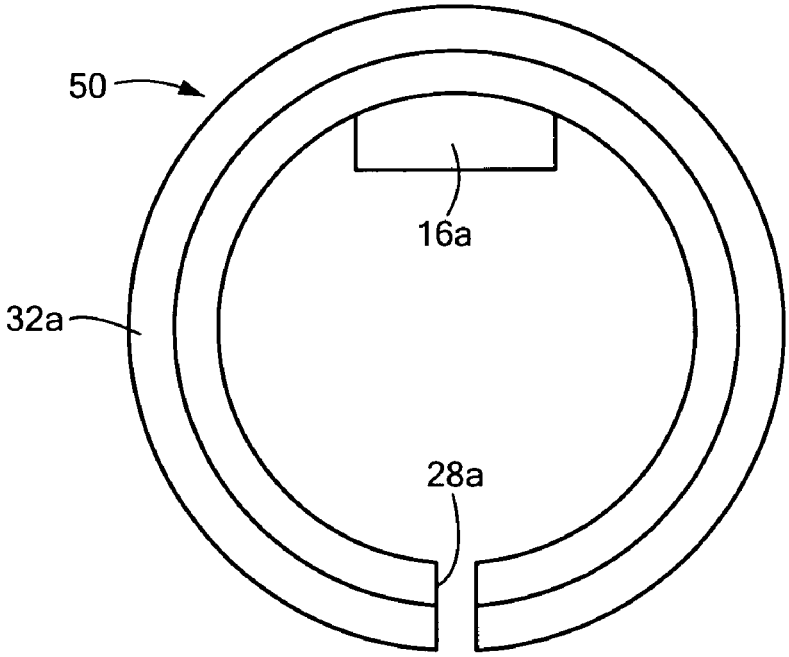

While so far the collar 12, collet 14 and collet lock 16 are shown as three discrete elements, two or more of their functions may be merged in a single element. Or all three can be merged in a single element as shown in FIGS. 8 and 9 where the combination collar 50 includes a lip 32*a* and a split 28*a* as in the nature of collet 14 and also has a detent 16*a* acting as a lock for engaging holes 22.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A shelf support system comprising;

a circularly cylindrical, tapered collet diverging from top to bottom for engaging a shelf post;

a collet lock for engaging a hole in the shelf post for arresting downward movement of the collet on the post; and a circularly cylindrical shelf support collar for securely engaging said tapered collet to support a shelf;

said collet including a lip about at least a part of the lower portion of said collet for further securing said shelf support collar, said collet further including a recess for nesting at least a portion of said collet lock.

2. The shelf support system of claim 1 in which said collet is longitudinally split to allow spreading of the collet for installation on a shelf pole.

3. The shelf support system of claim 1 in which said collet lock includes a lock portion for engaging a hole in a shelf post and a base contoured to said post.

4. The shelf support system of claim 1 further including a post with a plurality of spaced holes for receiving at least one collet lock.

5. The shelf support system of claim 1 in which the lip extends completely around the lower portion of the collet.

6. A shelf support system comprising;

a plurality of shelf posts each with a number of spaced holes;

a plurality of circularly cylindrical, tapered collets for engaging said shelf posts;

a plurality of collet locks one associated with each collet for engaging holes in said shelf posts for arresting downward movement of said collet on said post; and a plurality of circularly cylindrical shelf support collars for securely engaging each tapered collet to support a shelf;

each of said collets including a lip about at least a part of the lower portion of said collet for further securing each said shelf support collar, each of said collets further including a recess for nesting at least a portion of one of the plurality of collet locks.

7. The shelf support system of claim 6 in which each said collet is longitudinally split to allow spreading of the collet for installation on a shelf pole.

8. The shelf support system of claim 6 in which each said collet lock includes a lock portion for engaging a hole in a shelf post and a base contoured to said post.

9. A shelf support system comprising a combination collar comprising:

a circularly cylindrical collar member for mounting on a shelf post; and a lock member extending saliently inwardly of said collar member for engaging a hole in the shelf post, said collar member including a lip about at least a part of the lower portion of said collar member, the collar member further including a recess for nesting a portion of the lock member.

10. The shelf support system of claim 9 in which said collar member is longitudinally split to allow spreading of the collet for installation on a shelf post.

11. A shelf support system comprising:

a plurality of shelf posts each with a number of spaced holes;

a plurality of combination collars for engaging said shelf posts; each combination collar including a circularly cylindrical collar member for mounting on a shelf post and a lock member extending saliently inwardly of said collar member for engaging a hole in the shelf post, each said collar member including a lip about at least a part of the lower portion of said collar member, each collar member further including a recess for nesting a portion of the lock member.

12. The shelf support system of claim 11 in which said collar member is longitudinally split to allow spreading of the collet for installation on a shelf post.

* * * * *